US011225968B2

(12) United States Patent
Lee et al.

(10) Patent No.: US 11,225,968 B2
(45) Date of Patent: Jan. 18, 2022

(54) SCROLL COMPRESSOR

(71) Applicant: Hanon Systems, Daejeon (KR)

(72) Inventors: Kyung Jae Lee, Daejeon (KR); Jeong Ki Seo, Daejeon (KR)

(73) Assignee: Hanon Systems, Daejeon (KR)

( * ) Notice: Subject to any disclaimer, the term of this patent is extended or adjusted under 35 U.S.C. 154(b) by 1 day.

(21) Appl. No.: 16/732,534

(22) Filed: Jan. 2, 2020

(65) Prior Publication Data

US 2020/0232463 A1 Jul. 23, 2020

(30) Foreign Application Priority Data

Jan. 21, 2019 (KR) ..... 10-2019-0007318

(51) Int. Cl.
*F04C 18/02* (2006.01)
*F04C 29/12* (2006.01)
*F04C 29/06* (2006.01)

(52) U.S. Cl.
CPC ..... *F04C 18/0215* (2013.01); *F04C 18/0261* (2013.01); *F04C 29/068* (2013.01); *F04C 29/12* (2013.01); *F04C 2240/10* (2013.01); *F04C 2240/30* (2013.01); *F04C 2240/805* (2013.01)

(58) Field of Classification Search
CPC .. F04C 18/0215; F04C 18/0261; F04C 29/12; F04C 29/068; F04C 2240/30; F04C 2240/805; F04C 2240/10; F04C 18/0253; F04C 2250/101
See application file for complete search history.

(56) References Cited

U.S. PATENT DOCUMENTS

2006/0222545 A1* 10/2006 Nam ..... F04C 18/0253 418/55.1
2016/0273536 A1* 9/2016 Deguchi ..... H02K 5/161
2019/0301461 A1* 10/2019 Yamashita ..... F04C 18/0215

FOREIGN PATENT DOCUMENTS

| | | | |
|---|---|---|---|
| DE | 3938623 | A1 | 6/1990 |
| DE | 202004007708 | U1 | 1/2005 |
| DE | 112016004914 | T5 | 7/2018 |
| DE | 102019107752 | A1 | 10/2019 |
| JP | H07332259 | A | 12/1995 |
| JP | 2002317776 | A | 10/2002 |

(Continued)

*Primary Examiner* — Mark A Laurenzi
*Assistant Examiner* — Xiaoting Hu
(74) *Attorney, Agent, or Firm* — Norton Rose Fulbright US LLP; James R. Crawford

(57) ABSTRACT

A scroll compressor including a center housing; a front housing fastened to the center housing and forming a suction chamber; a rear housing fastened to the center housing and forming a compression mechanism accommodation space. Fixed scroll is in the compression mechanism accommodation space. An orbiting scroll interposes between the center housing and the fixed scroll forming a compression chamber together with the fixed scroll. Fixed scroll may include a fixed scroll end plate and a fixed scroll side plate protruded from outer circumferential portion of fixed scroll end plate, fastened to the center housing, and forming orbiting space of orbiting scroll. Outer circumferential portion of the center housing may be formed with an inflow hole for communicating with the suction chamber. Distal end surface of the fixed scroll side plate is formed with a suction port for guiding the refrigerant of the inflow hole to the compression chamber.

15 Claims, 9 Drawing Sheets

(56) References Cited

FOREIGN PATENT DOCUMENTS

| | | | |
|---|---|---|---|
| JP | 2006283753 | A | 10/2006 |
| JP | 2015083781 | A | 4/2015 |
| KR | 20180094483 | A | 8/2018 |
| KR | 101979384 | B1 | 5/2019 |
| WO | 2017013987 | A1 | 1/2017 |

* cited by examiner

SCROLL COMPRESSOR

CROSS-REFERENCE(S) TO RELATED APPLICATIONS

This application claims priority to Korean Patent Application No. 10-2019-0007318, filed on Jan. 21, 2019, the entire disclosure of which is hereby incorporated herein by reference.

BACKGROUND OF THE DISCLOSURE

Field of the Disclosure

The present disclosure relates to a scroll compressor, and more particularly, to a scroll compressor capable of compressing refrigerant by a fixed scroll and an orbiting scroll.

Description of the Related Art

In general, a vehicle is installed with an air conditioning (A/C) for the cooling and heating of the indoor. Such an air conditioning includes, as a configuration of a cooling system, a compressor for compressing a low temperature and low pressure gaseous refrigerant introduced from an evaporator into a high temperature and high pressure gaseous refrigerant to send it to a condenser.

The compressor includes a reciprocating type for compressing the refrigerant according to the reciprocating motion of a piston and a rotary type for performing the compression while performing the rotational motion. The reciprocating type includes a crank type for delivering to a plurality of pistons by using a crank, a swash plate type for delivering to a rotary shaft installed with a swash plate, and the like according to the delivery method of a drive source, and the rotary type includes a vane rotary type that uses a rotating rotary shaft and vane, and a scroll type that uses an orbiting scroll and a fixed scroll.

The scroll compressor is widely used for the refrigerant compression in the air conditioning, and the like because it has the advantage in that the suction, compression, and discharge strokes of the refrigerant may be smooth to obtain a stable torque while obtaining a relatively high compression ratio compared to other types of compressors.

FIG. 1 is a cross-sectional diagram illustrating a conventional scroll compressor.

Referring to FIG. 1, the conventional scroll compressor includes a center housing 110, a front housing 120 fastened to the center housing 110 and forming a suction chamber (S1), a motor 200 provided in the suction chamber (S1), a fixed scroll 500 fastened to the center housing 110 at the opposite side of the front housing 120 with respect to the center housing 110 and forming an orbiting space (S3) of an orbiting scroll 400 to be described later, the orbiting scroll 400 interposed between the center housing 110 and the fixed scroll 500 and forming a compression chamber (S4) together with the fixed scroll 500, and a rear housing 130 fastened to the fixed scroll 500 at the opposite side of the center housing 110 with respect to the rotary shaft 300 for connecting the motor 200 with the orbiting scroll 400 through the center housing 110 and the fixed scroll 500 and forming a discharge chamber (S5).

Here, the center housing 110 includes an inflow hole 112*c* for guiding the refrigerant in the suction chamber (S1) to the orbiting space (S3).

In the conventional scroll compressor according to such a configuration, if power is applied to the motor 200, the rotary shaft 300 is rotated by the motor 200, the orbiting scroll 400 receives the rotational force from the rotary shaft 300 to perform the orbiting motion, and the compression chamber (S4) is continuously moved toward the center side to reduce the volume. Further, the refrigerant flows into the orbiting space (S3) from the suction chamber (S1) through the inflow hole 112*c*, the refrigerant in the orbiting space (S3) flows into the compression chamber (S4), and the refrigerant flowing into the compression chamber (S4) is compressed while being moved to the center side along the movement path of the compression chamber (S4) to be discharged to the discharge chamber (S5).

However, in the conventional scroll compressor, there has been a problem in that as the fixed scroll 500 is exposed to the outside, the noise generated in the compression chamber (S4) is radiated to the outside through the fixed scroll 500.

Meanwhile, it may be considered to have the fixed scroll 500 provided inside the housing 100 to reduce that the noise generated in the compression chamber (S4) is radiated to the outside, but in this case, there has been a problem in that the orbiting radius of the orbiting scroll 400 is reduced to reduce the amount of refrigerant discharged. Further, in this case, there has been a problem in that the fixed scroll 500 blocks the inflow hole 112*c* not to smoothly supply the refrigerant to the compression chamber (S4).

SUMMARY OF THE DISCLOSURE

Therefore, an object of the present disclosure is to provide a scroll compressor capable of preventing the noise generated in a compression chamber from being radiated to the outside.

Further, another object of the present disclosure is to provide a scroll compressor capable of increasing the amount of refrigerant discharged, and smoothly supplying the refrigerant to the compression chamber.

For achieving the objects, the present disclosure provides a scroll compressor including a center housing; a front housing fastened to the center housing and forming a suction chamber; a rear housing fastened to the center housing and forming a compression mechanism accommodation space; a fixed scroll provided in the compression mechanism accommodation space; and an orbiting scroll interposed between the center housing and the fixed scroll and forming a compression chamber together with the fixed scroll, and the fixed scroll includes a fixed scroll end plate and a fixed scroll side plate protruded from the outer circumferential portion of the fixed scroll end plate, fastened to the center housing, and forming an orbiting space of the orbiting scroll, the outer circumferential portion of the center housing is formed with an inflow hole for communicating with the suction chamber, the distal end surface of the fixed scroll side plate is formed with a suction port for guiding the refrigerant of the inflow hole to the compression chamber, the suction port includes a first suction port formed to be engraved from the distal end surface of the fixed scroll side plate, and the circumferential length of the first suction port is formed longer than the circumferential length of the inflow hole.

The fixed scroll side plate may be formed to overlap the inflow hole in the axial direction.

The suction port may further include a second suction port formed to be engraved from the first suction port.

The circumferential length of the second suction port may be formed shorter than the circumferential length of the first suction port.

The orbiting scroll may includes an orbiting scroll end plate and an orbiting scroll lap protruded from the orbiting scroll end plate and engaged with the fixed scroll, and the axial height of the second suction port may be formed higher than the axial height of the orbiting scroll end plate.

The second suction port may be formed to overlap the orbiting scroll lap in the radius direction.

The axial height of the first suction port may be formed to be equal to or lower than the axial height of the orbiting scroll end plate.

The first suction port may be formed to overlap the orbiting scroll end plate in the radius direction.

The inflow hole, the first suction port, and the second suction port may be formed in plural, respectively, the plurality of first suction ports may overlap the plurality of inflow holes in the axial direction, and the fixed scroll side plate may include a contact part contacting the center housing between the plurality of first suction ports.

The sum of the flow cross-sectional areas of the plurality of second suction ports may be formed to be greater than or equal to the sum of the flow cross-sectional areas of the plurality of inflow holes.

The center housing may include a main frame for supporting the fixed scroll and the orbiting scroll; and a plurality of ribs formed radially at the suction chamber side to reinforce the rigidity of the main frame, and the plurality of ribs may be formed not to reduce the flow cross-sectional area of the inflow hole.

The plurality of ribs may include a non-overlapping rib not overlapping the inflow hole in the axial direction; and an overlapping rib overlapping the inflow hole in the axial direction, and the overlapping rib may include a cutout part formed to be engraved from the compression mechanism accommodation space side and for communicating with the inflow hole.

The cutout part may be formed to be further engraved in the suction chamber side than the inflow hole.

A groove may be formed between the plurality of ribs, and the cutout part may be formed to communicate with the groove.

The center housing may include a protrusion protruded from the outer circumferential surface of the center housing in the radius direction, and the protrusion may be formed with a fastening hole into which a fastening bolt for fastening the center housing and the rear housing is inserted.

The fixed scroll side plate may include a recess formed to be engraved from the outer circumferential surface of the fixed scroll side plate not to interfere with a fastening member.

The protrusion, the fastening hole, and the recess may be formed in plural, respectively, and the fixed scroll side plate may include a contact part contacting the center housing between the plurality of recesses.

The scroll compressor according to the present disclosure may include the center housing; the front housing fastened to the center housing and forming the suction chamber; the rear housing fastened to the center housing and forming the compression mechanism accommodation space; the fixed scroll provided in the compression mechanism accommodation space; and the orbiting scroll interposed between the center housing and the fixed scroll and forming the compression chamber together with the fixed scroll, and the fixed scroll may include the fixed scroll end plate and the fixed scroll side plate protruded from the outer circumferential portion of the fixed scroll end plate, fastened to the center housing, and forming the orbiting space of the orbiting scroll, the inflow hole communicating with the suction chamber may be formed in the outer circumferential portion of the center housing, the suction port for guiding the refrigerant of the inflow hole to the compression chamber may be formed on the distal end surface of the fixed scroll side plate, the suction port may include the first suction port formed to be engraved from the distal end surface of the fixed scroll side plate, and the circumferential length of the first suction port may be formed longer than the circumferential length of the inflow hole, thereby preventing the noise generated from the compression chamber from being radiated to the outside.

Further, it is possible to increase the amount of the refrigerant discharged by increasing the orbiting radius of the orbiting scroll, and to smoothly supply the refrigerant to the compression chamber because the fixed scroll does not block the inflow hole.

DESCRIPTION OF SPECIFIC EMBODIMENTS

Hereinafter, a scroll compressor according to the present disclosure will be described in detail with reference to the accompanying drawings.

Figure 1:
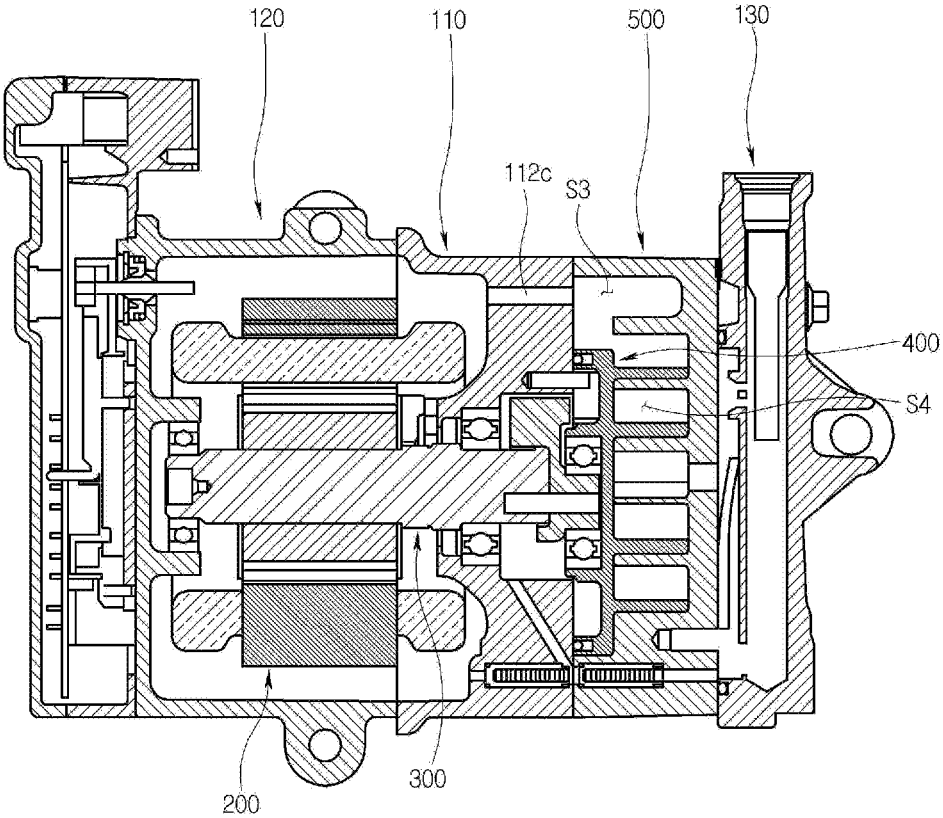
FIG. 1 is a cross-sectional diagram illustrating a conventional scroll compressor.
Figure 2:
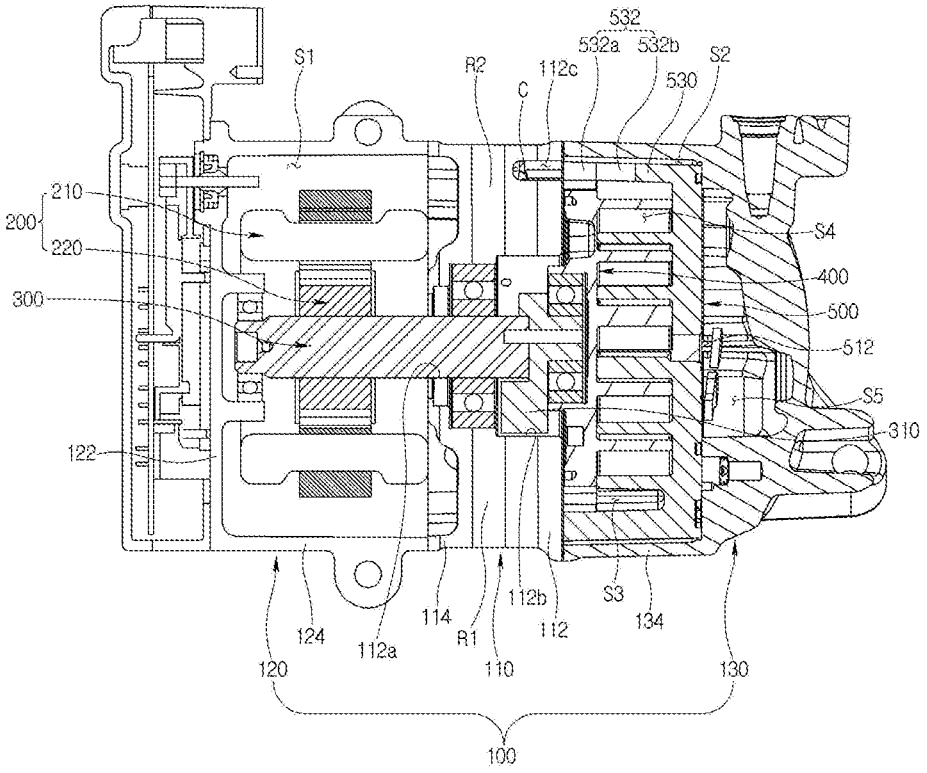
FIG. 2 is a cross-sectional diagram illustrating a scroll compressor according to an embodiment of the present disclosure.
Figure 3:
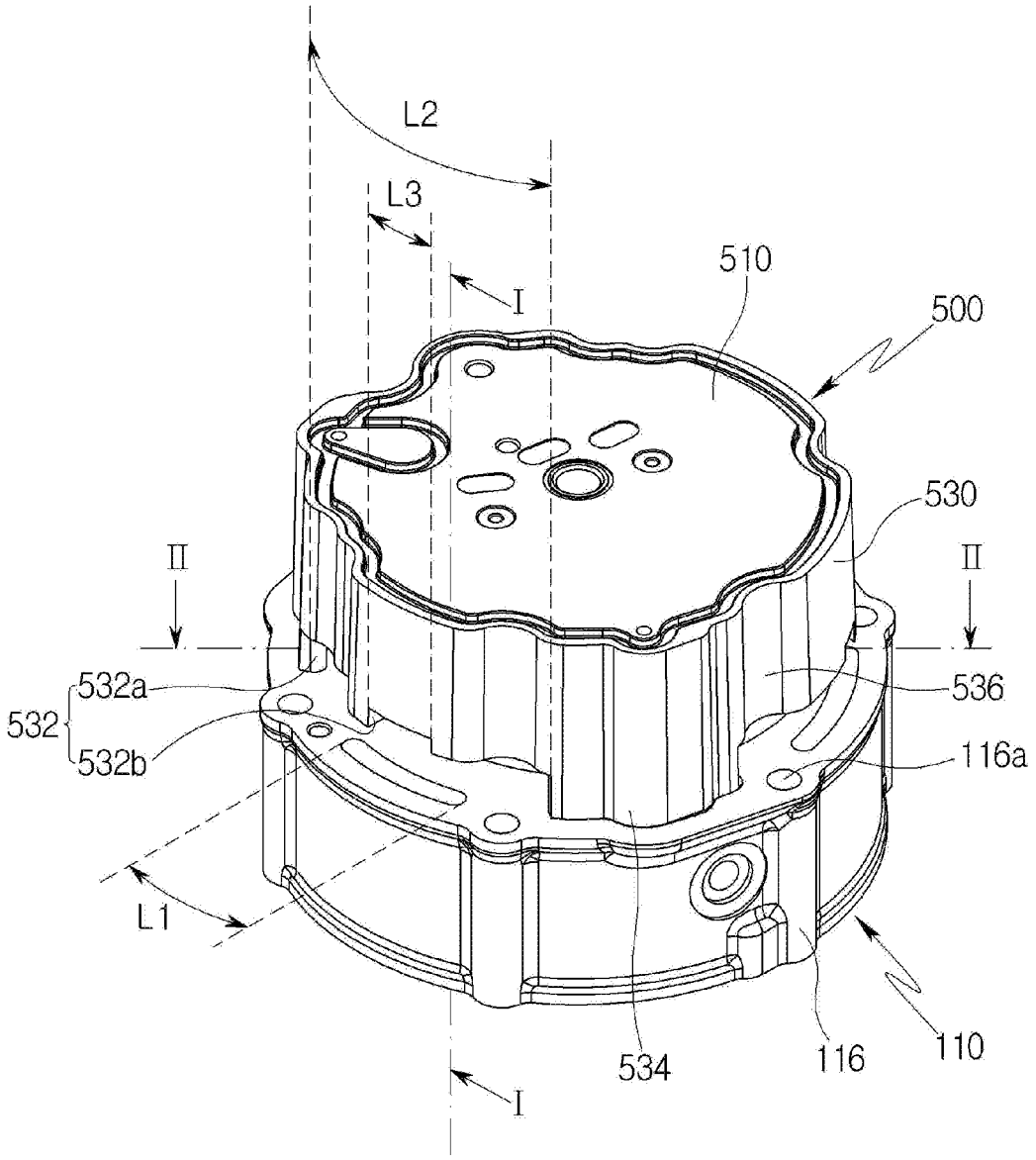
FIG. 3 is a perspective diagram illustrating a center housing and a compression mechanism in the scroll compressor in FIG. 2.
Figure 4:
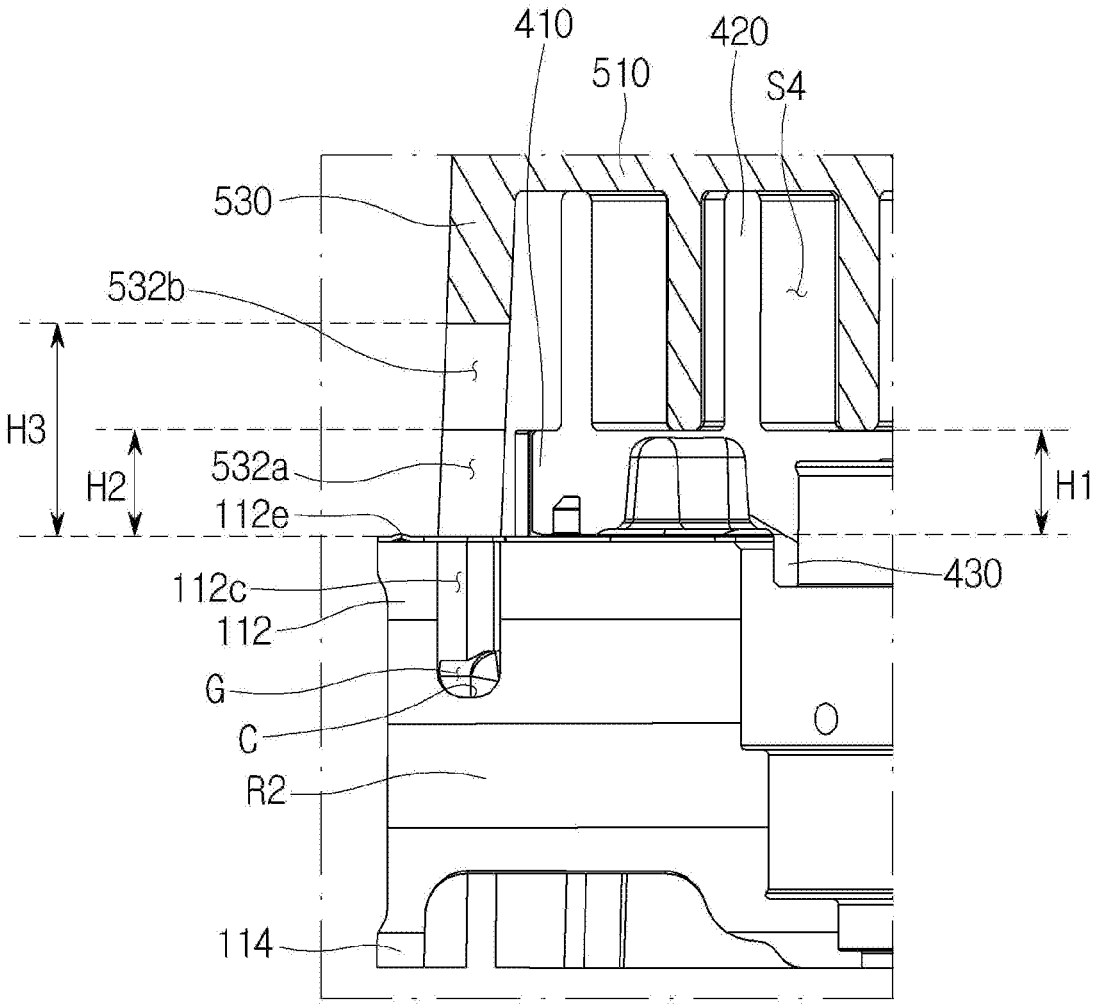
FIG. 4 is a cross-sectional diagram taken along the line I-I in FIG. 3.
Figure 5:
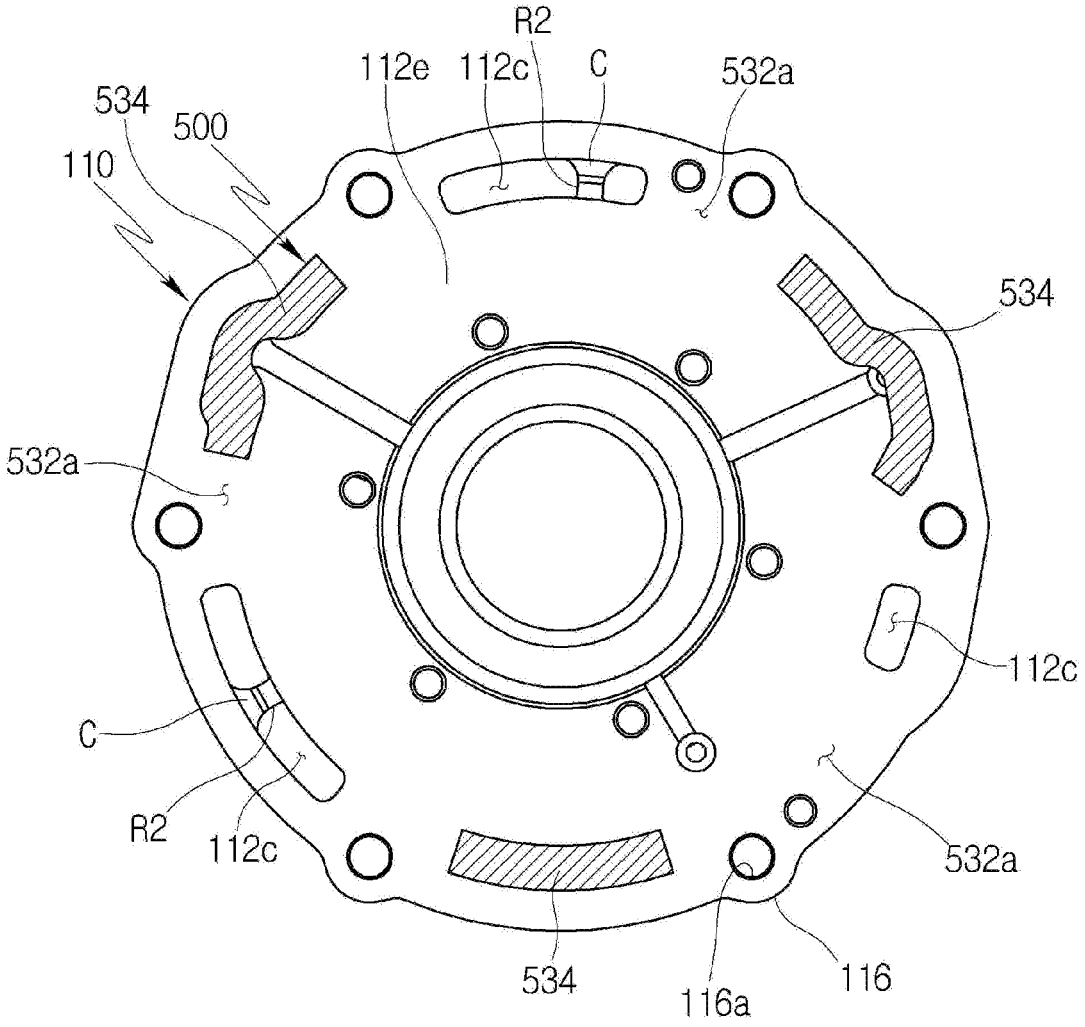
FIG. 5 is a cross-sectional diagram taken along the line II-II in FIG. 3.
Figure 6:
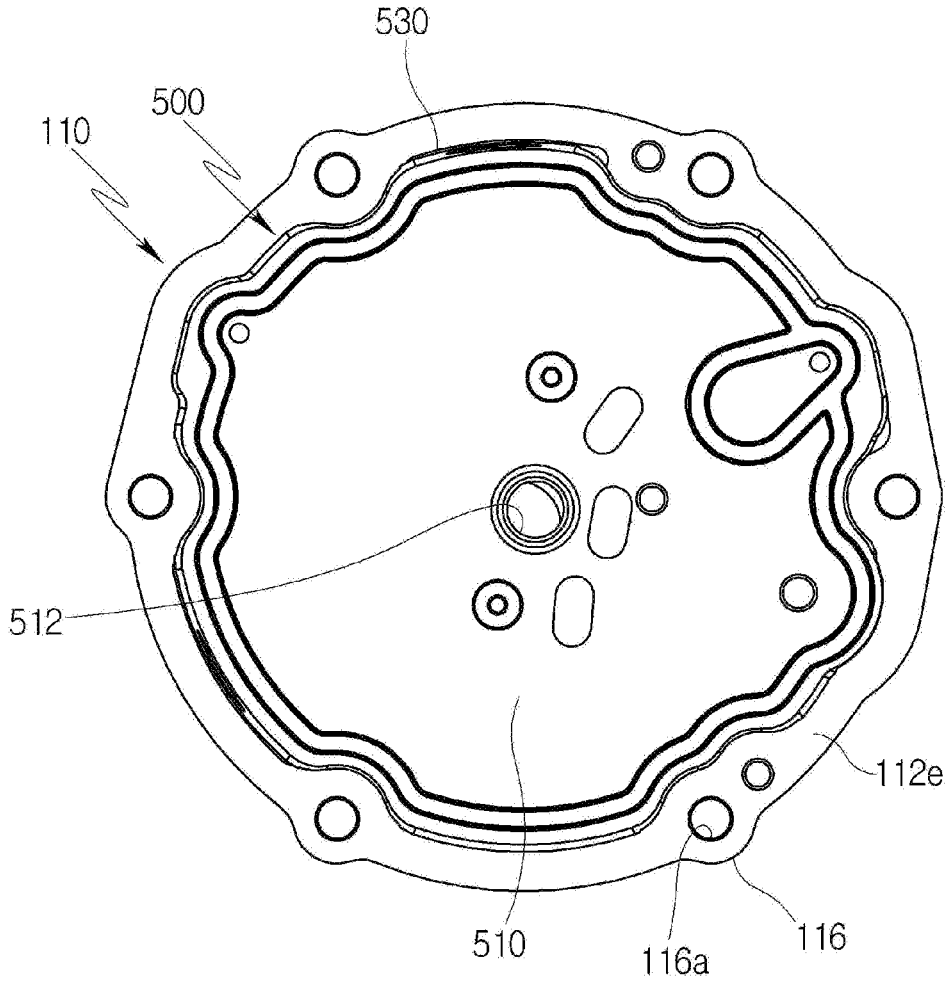
FIG. 6 is a plane diagram of FIG. 3.
Figure 7:
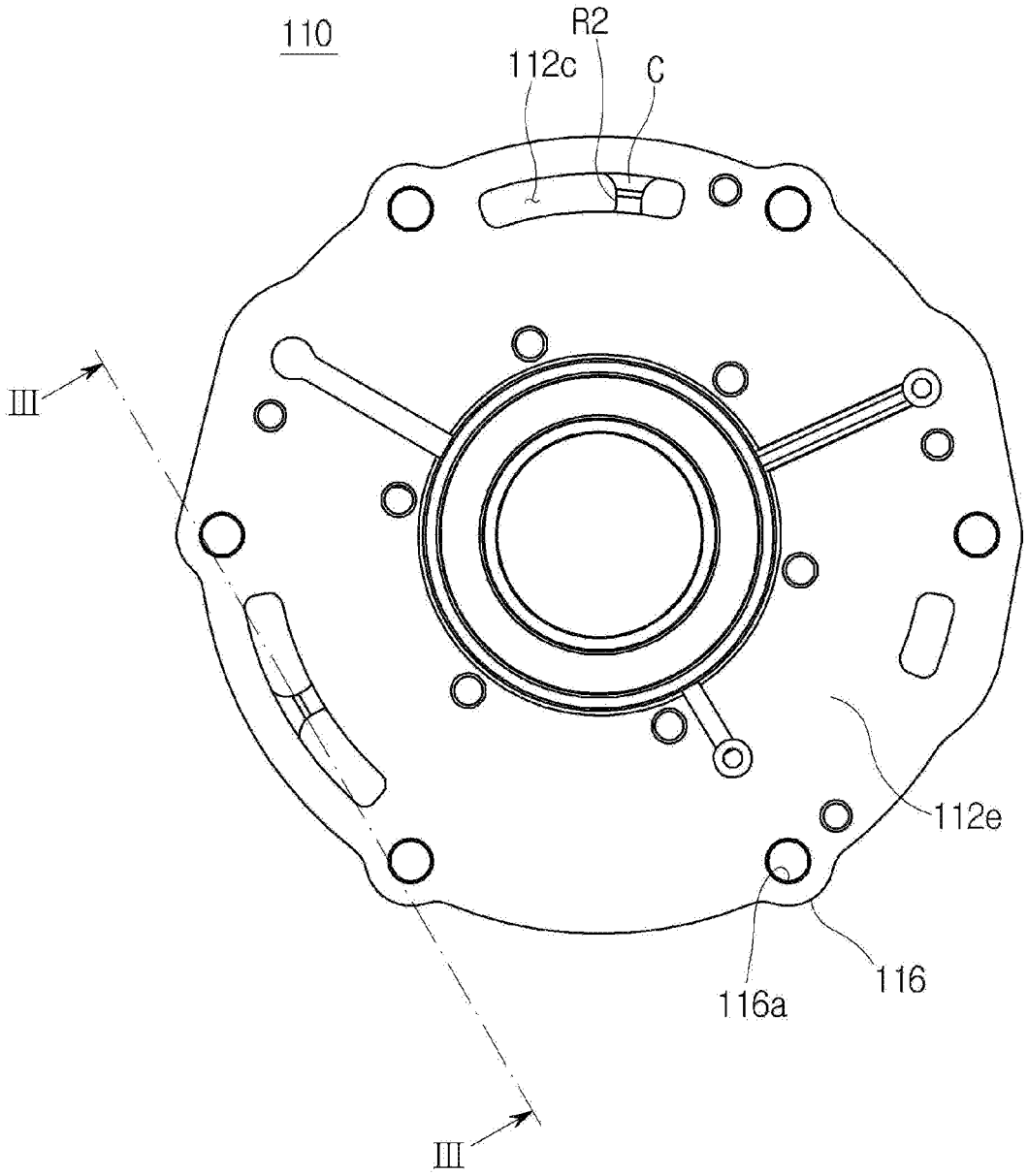
FIG. 7 is a plane diagram illustrating the center housing in FIG. 3.
Figure 8:
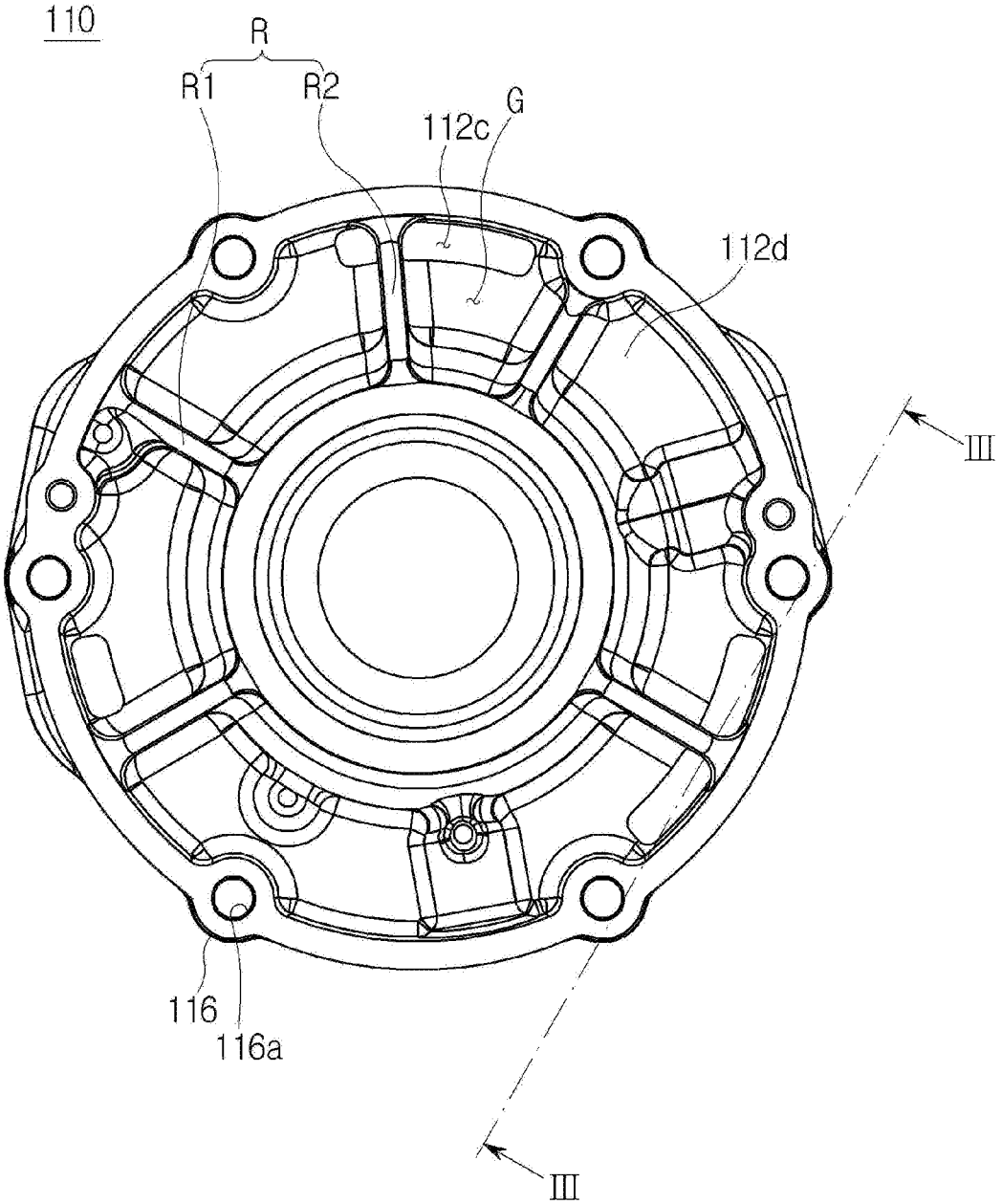
FIG. 8 is a bottom diagram illustrating the center housing in FIG. 3.
Figure 9:
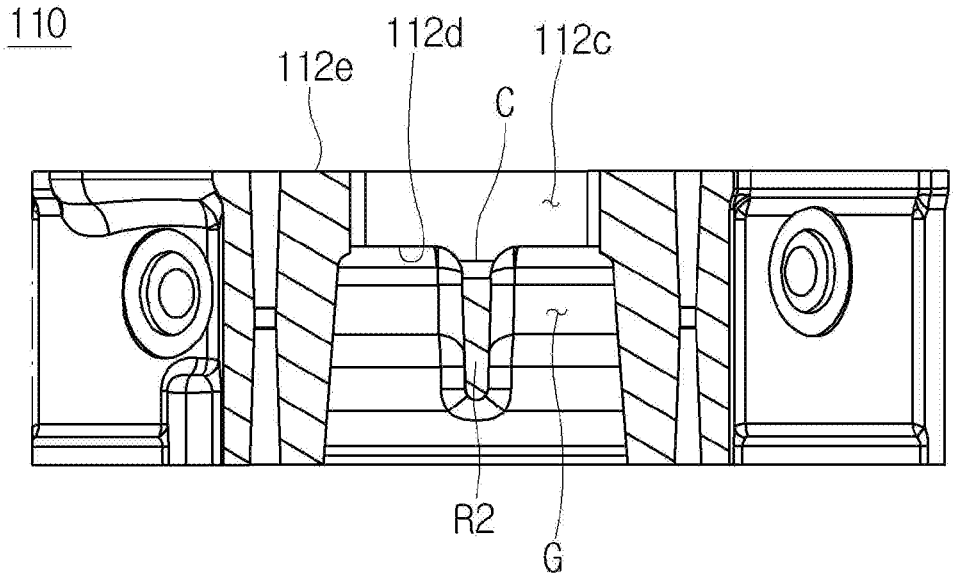
FIG. 9 is a cross-sectional diagram taken along the line in FIGS. 7 and 8.

FIG. 2 is a cross-sectional diagram illustrating a scroll compressor according to an embodiment of the present disclosure, FIG. 3 is a perspective diagram illustrating a center housing and a compression mechanism in the scroll compressor in FIG. 2, FIG. 4 is a cross-sectional diagram taken along the line I-I in FIG. 3, FIG. 5 is a cross-sectional diagram taken along the line II-II in FIG. 3, FIG. 6 is a plane diagram of FIG. 3, FIG. 7 is a plane diagram illustrating the center housing in FIG. 3, FIG. 8 is a bottom diagram illustrating the center housing in FIG. 3, and FIG. 9 is a cross-sectional diagram taken along the line in FIGS. 7 and 8.

Referring to FIGS. 2 to 9, a scroll compressor according to an embodiment of the present disclosure may include a housing 100, a motor 200 for generating a rotational force inside the housing 100, a rotary shaft 300 rotated by the motor 200, an orbiting scroll 400 for performing the orbiting motion by the rotary shaft 300, and a fixed scroll 500 engaged with the orbiting scroll 400 to form a pair of compression chambers (S4).

The housing 100 may include a center housing 110, a front housing 120 fastened to the center housing 110 and forming a suction chamber (S1), and a rear housing 130 fastened to the center housing 110 at the opposite side of the front housing 120 with respect to the center housing 110 and forming a space (hereinafter, a compression mechanism accommodation space) (S2) for accommodating the orbiting scroll 400 and the fixed scroll 500.

Here, a direction of the front housing 120 side (a left direction in FIG. 2) with respect to the center housing 110 is referred to as the front, and a direction of the rear housing 130 side (a right direction in FIG. 2) with respect to the center housing 110 is referred to as the rear.

The center housing 110 may include a main frame 112 for partitioning the suction chamber (S1) and the compression mechanism accommodation space (S2) and supporting the orbiting scroll 400 and the fixed scroll 500 and a center housing side plate 114 protruded from the outer circumference portion of the main frame 112 to the front housing 120 side.

The main frame 112 may be formed in a substantially disk shape, and the center portion of the main frame 112 may be formed with a bearing hole 112*a* through which one end portion of the rotary shaft 300 passes and a back pressure chamber 112*b* for pressing the orbiting scroll 400 to the fixed scroll 500 side. Here, one end portion of the rotary shaft 300 is formed with an eccentric bush 310 for converting the rotational motion of the rotary shaft 300 into the orbiting motion of the orbiting scroll 400, and the back pressure chamber 112*b* also provides a space where the eccentric bush 310 may be rotated.

Further, the outer circumferential portion of the main frame 112 may be formed with an inflow hole 112*c* for communicating with the suction chamber (S1).

The inflow hole 112*c* may be formed by passing through the main frame 112 in the axial direction of the rotary shaft 300 (hereinafter, the axial direction). That is, if the surface facing the suction chamber (S1) in the main frame 112 is referred to as a main frame front surface 112*d*, and the surface facing the compression mechanism accommodation space (S2) in the main frame 112 is referred to as a main frame rear surface 112*e*, the inflow hole 112*c* may be formed to pass through the main frame 112 from the main frame front surface 112*d* to the main frame rear surface 112*e*.

Further, the inflow hole 112*c* may be formed to extend along the circumferential direction of the rotary shaft 300 (hereinafter, the circumferential direction).

Further, the inflow hole 112*c* may be formed in plural, and the plurality of inflow holes 112*c* may be arranged along the circumferential direction.

Meanwhile, the center housing 110 may further include a rib (R) for reinforcing the rigidity of the main frame 112.

The rib (R) may be formed at the suction chamber (S1) side not to interfere with the orbiting scroll 400 and the fixed scroll 500. That is, the rib (R) may be formed to be protruded from the main frame front surface 112*d* to the suction chamber (S1) side.

Further, the rib (R) may be formed in plural to further improve the rigidity of the main frame 112, the plurality of ribs (R) may be formed radially with respect to the center portion of the main frame 112, and a groove (G) may be formed between the plurality of ribs (R).

Here, as the plurality of ribs (R) are formed radially, they may include a non-overlapping rib (R1) disposed between the plurality of inflow holes 112*c* and an overlapping rib (R2) disposed within a range of the inflow hole 112*c*.

Since the non-overlapping rib (R1) does not overlap the inflow hole 112*c* in the axial direction, the flow cross-sectional area of the inflow hole 112*c* (the area of the inflow hole 112*c* on the cross section perpendicular to the axial direction) may not be reduced.

On the other hand, the overlapping rib (R2) may overlap the inflow hole 112*c* in the axial direction, thereby reducing the flow cross-sectional area of the inflow hole 112*c*. That is, if the overlapping rib (R2) is formed to extend up to the main frame rear surface 112*e*, a portion of the inflow hole 112*c* may be buried by the overlapping rib (R2).

Considering the above, in the present embodiment, the overlapping rib (R2) may include a cutout part (C) formed to be engraved from the compression mechanism accommodation space (S2) side to the suction chamber (S1) side at a position of overlapping the inflow hole 112*c* in the axial direction and for communicating with the inflow hole 112*c* so that the flow cross-sectional area of the inflow hole 112*c* is not reduced, that is, the inflow hole 112*c* is not buried by the overlapping rib (R2).

Further, the cutout part (C) may be formed to also communicate with the groove (G) so that the refrigerant in the suction chamber (S1) flows into the inflow chamber more smoothly. That is, the cutout part (C) may be formed to be further engraved in the suction chamber (S1) side than the inflow hole 112*c*.

Further, the center housing 110 may include a protrusion 116 protruded from the outer circumferential surface of the center housing 110 in the radius direction in order to secure the inside space as much as possible while minimizing the outer diameter of the center housing 110, and a fastening hole 116*a* into which a fastening bolt (not illustrated) for fastening the center housing 110 and the rear housing 130 is inserted may be formed in the protrusion 116.

Here, the fastening bolt (not illustrated) may be provided in plural, the fastening hole 116*a* may be formed in the same number as the number of the plurality of fastening bolts (not illustrated) to correspond to the plurality of fastening bolts (not illustrated), and the protrusion 116 may be formed in the same number as the number of the plurality of fastening holes 116*a* to correspond to the plurality of fastening holes 116*a*.

The front housing 120 may include a front housing end plate 122 facing the main frame 112 and for supporting the other end portion of the rotary shaft 300 and a front housing side plate 124 protruded from the outer circumferential portion of the front housing end plate 122, fastened to the center housing side plate 114, and for supporting the motor 200.

Here, the main frame 112, the center housing side plate 114, the front housing end plate 122, and the front housing side plate 124 may form the suction chamber (S1).

Further, the front housing side plate 124 may be formed with a suction port (not illustrated) for communicating with a refrigerant suction tube (not illustrated) for guiding the refrigerant from the outside to the suction chamber (S1).

The rear housing 130 may include a rear housing end plate 132 facing the main frame 112 and a rear housing side plate 134 protruded from the outer circumferential portion of the rear housing end plate 132 and fastened to the outer circumferential portion of the main frame 112.

Here, the main frame 112, the rear housing end plate 132, and the rear housing side plate 134 may form the compression mechanism accommodation space (S2).

Further, the rear housing end plate 132 may be formed with a discharge chamber (S5) for accommodating the refrigerant discharged from the compression chamber (S4).

Further, the rear housing end plate 132 may be formed with a discharge port (not illustrated) for communicating with a refrigerant discharge tube (not illustrated) for guiding the refrigerant in the discharge chamber (S5) to the outside.

The motor 200 may include a stator 210 fixed to the front housing side plate 124 and a rotor 220 rotated in interaction with the stator 210 inside the stator 210.

The rotary shaft 300 is fastened to the rotor 220, and one end portion of the rotary shaft 300 may pass through the bearing hole 112*a* of the main frame 112 through the center portion of the rotor 220 and the other end portion of the rotary shaft 300 may be supported by the front housing end plate 122.

The orbiting scroll 400 may include a disk-shaped orbiting scroll end plate 410 interposed between the main frame 112 and the fixed scroll 500, an orbiting scroll lap 420 protruded from the center portion of the orbiting scroll end plate 410 to the fixed scroll 500 side, and an orbiting scroll boss 430 protruded from the center portion of the orbiting scroll end plate 410 to the opposite side of the orbiting scroll lap 420 and fastened to the eccentric bush 310.

The fixed scroll 500 may include a disk-shaped fixed scroll end plate 510, a fixed scroll lap 520 protruded from the center portion of the fixed scroll end plate 510 and engaged with the orbiting scroll lap 420, and a fixed scroll side plate 530 protruded from the outer circumferential portion of the fixed scroll end plate 510, fastened to the main frame 112, and forming the orbiting space (S3) of the orbiting scroll 400.

The center side of the fixed scroll end plate 510 may be formed with a discharge port 512 for discharging the refrigerant in the compression chamber (S4) to the discharge chamber (S5).

The fixed scroll side plate 530 may be formed as close to the rear housing side plate 134 as possible within a range that does not interfere with the rear housing side plate 134 so that the orbiting radius of the orbiting scroll 400 is increased as much as possible. That is, the fixed scroll side plate 530 may be formed to overlap the inflow hole 112*c* in the axial direction.

Further, the fixed scroll side plate 530 may include a recess 536 formed to be engraved from the outer circumferential surface of the fixed scroll side plate 530 not to interfere with the fastening member while maximizing the outer diameter of the fixed scroll side plate 530.

The recess 536 may be formed in the same number as the number of the plurality of fastening bolts (not illustrated) to correspond to the plurality of fastening bolts (not illustrated).

However, as the fixed scroll side plate 530 overlaps the inflow hole 112*c* in the axial direction, the inflow hole 112*c* may be blocked by the fixed scroll side plate 530, such that in order to prevent the above, the fixed scroll side plate 530 according to the present embodiment may include a contact part 534 contacting the center housing 110 and a suction port 532 formed to be engraved from the distal end surface of the fixed scroll side plate 530 to guide the refrigerant of the inflow hole 112*c* to the compression chamber (S4).

Here, the contact part 534 may contact the center housing 110 between the plurality of recesses 536. Further, the contact part 534 may contact the center housing 110 between the plurality of suction ports 532 when the suction port 532 is formed in plural as described later.

The suction port 532 may be formed in multiple stages to suppress the rigidity of the fixed scroll side plate 530 from being weakened by the suction port 532.

Specifically, the suction port 532 may include a first suction port 532*a* formed to be engraved from the distal end surface of the fixed scroll side plate 530 to the fixed scroll end plate 510 side and a second suction port 532*b* formed to be further engraved from the first suction port 532*a* to the fixed scroll end plate 510 side.

The circumferential length (L2) of the first suction port 532*a* may be formed longer than the circumferential length (L1) of the inflow hole 112*c* so that the first suction port 532*a* smoothly guides not only the refrigerant in the inflow hole 112*c* but also the refrigerant in the compression mechanism accommodation space (S2) (more accurately, a space between the fixed scroll side plate 530 and the rear housing side plate 134) to the compression chamber (S4).

Further, in the first suction port 532*a*, in order to minimize that the area of the fixed scroll side plate 530 is reduced to weaken the rigidity of the fixed scroll side plate 530 as the circumferential length (L2) of the first suction port 532*a* is formed longer, the axial height (H2) of the first suction port 532*a* (the axial distance from the main frame rear surface 112*e* to the first suction port 532*a*) may be formed to be equal to or lower than the axial height (H1) of the orbiting scroll end plate 410 (the axial distance from the main frame rear surface 112*e* to the rear surface of the orbiting scroll end plate 410). That is, the first suction port 532*a* communicates with the inflow hole 112*c* and the orbiting space (S3) and may be formed to overlap the orbiting scroll end plate 410 in the radius direction of the rotary shaft 300 (hereinafter, the radius direction).

However, as the axial height (H2) of the first suction port 532*a* is formed to be equal to or lower than the axial height (H1) of the orbiting scroll end plate 410, the refrigerant flowing into the orbiting space (S3) through the first suction port 532*a* may be intermittently supplied to the compression chamber (S4). That is, an operation in which the orbiting scroll end plate 410 is moved away from and approaches the first suction port 532*a* by the orbiting motion of the orbiting scroll 400 is repeatedly performed, and the first suction port 532*a* may not be closed by the orbiting scroll end plate 410 when the orbiting scroll end plate 410 is moved away from the first suction port 532*a*. Therefore, the refrigerant may flow into the orbiting space (S3) through the first suction port 532*a*, and the refrigerant in the orbiting space (S3) may be supplied to the suction chamber (S1). On the other hand, the first suction port 532*a* may be closed by the orbiting scroll end plate 410 when the orbiting scroll end plate 410 approaches the first suction port 532*a*. Therefore, the supply of the refrigerant to the orbiting space (S3) and the compression chamber (S4) through the first suction port 532*a* may be cut off.

Considering the above, in the present embodiment, a second suction port 532*b* may be further formed so that the refrigerant is continuously supplied to the compression chamber (S4), and the axial height (H3) of the second suction port 532*b* (the axial distance from the main frame rear surface 112*e* to the second suction port 532*b*) may be formed higher than the axial height (H1) of the orbiting scroll end plate 410. That is, the second suction port 532*b* may be formed to overlap the orbiting scroll lap 420 in the radius direction.

Further, in the second suction port 532*b*, in order to minimize that the area of the fixed scroll side plate 530 is reduced by the second suction port 532*b* to weaken the rigidity of the fixed scroll side plate 530, the circumferential length (L3) of the second suction port 532*b* may be formed shorter than the circumferential length (L2) of the first suction port 532*a*.

Further, the second suction port 532*b* may be formed to have a predetermined size or more not to become a bottle neck. That is, the flow cross-sectional area of the second suction port 532*b* (the area of the second suction port 532*b* in the circumferential direction) may be formed to be greater than or equal to the flow cross-sectional area of the inflow hole 112*c*. Further, if the first suction port 532*a* is formed in plural (the same number as the number of the plurality of inflow holes 112*c*) to correspond to the plurality of inflow holes 112*c*, and the second suction port 532*b* is formed in plural (the same number as the number of the plurality of the first suction ports 532*a*) to correspond to the plurality of first suction ports 532*a*, the sum of the flow cross-sectional areas of the plurality of second suction ports 532*b* may be formed to be greater than or equal to the sum of the flow cross-sectional areas of the plurality of inflow holes 112*c*.

Hereinafter, the operation and effect of the scroll compressor according to the present embodiment will be described.

That is, if power is applied to the motor 200, the rotary shaft 300 may be rotated together with the rotor 220.

Further, the orbiting scroll 400 may receive the rotational force from the rotary shaft 300 through the eccentric bush 310 to perform the orbiting motion.

Therefore, the compression chamber (S4) may be reduced in volume while being continuously moved toward the center side thereof.

Further, the refrigerant may flow into the compression chamber (S4) through the refrigerant suction tube (not illustrated), the suction chamber (S1), the groove (G), the cutout part (C), the inflow hole 112*c*, and the suction port 532.

Further, the refrigerant sucked into the compression chamber (S4) may be compressed while being moved to the center side along the movement path of the compression chamber (S4) to be discharged to the discharge chamber (S5) through the discharge port 512.

Further, the refrigerant discharged into the discharge chamber (S5) may be discharged to the outside of the compressor through the refrigerant discharge tube (not illustrated).

Here, in the scroll compressor according to the present embodiment, as the orbiting scroll 400 and the fixed scroll 500 are accommodated in the housing 100, the noise generated in the compression chamber (S4) may be reduced by the housing 100. Therefore, it is possible to prevent the noise generated in the compression chamber (S4) from being radiated to the outside of the housing 100.

Further, the fixed scroll end plate 510, the fixed scroll side plate 530, and the main frame 112 may form the orbiting space (S3) of the orbiting scroll 400, and as the fixed scroll side plate 530 overlaps the inflow hole 112*c* in the axial direction and is formed as close to the rear housing side plate 134 as possible, the orbiting radius of the orbiting scroll 400 may be increased. Therefore, it is possible to increase the amount of refrigerant discharged while maintaining the axial height of the compression chamber (S4) at a predetermined level. That is, it is possible to increase the amount of refrigerant discharged while maintaining the rigidity of the orbiting scroll lap 420 and the fixed scroll lap 520 at a predetermined level. Alternatively, it is possible to reduce the outer diameter of the housing 100 while maintaining the amount of refrigerant discharged at a predetermined level. Therefore, it is possible to reduce the weight and cost of the scroll compressor, and to improve the vehicle mountability.

Further, as the suction port 532 is formed on the distal end surface of the fixed scroll side plate 530, the inflow hole 112*c* may not be covered by the fixed scroll side plate 530 even if the fixed scroll side plate 530 overlaps the inflow hole 112*c* in the axial direction.

Further, as the suction port 532 includes the first suction port 532*a* and the second suction port 532*b*, it is possible to smoothly supply the refrigerant to the compression chamber (S4) while minimizing that the rigidity of the fixed scroll side plate 530 is reduced.

Further, as the plurality of ribs (R) for reinforcing the main frame 112 include the non-overlapping rib (R1) and the overlapping rib (R2) also includes the cutout part (C), it is possible to prevent the flow cross-sectional area of the inflow hole 112*c* from being reduced by the plurality of ribs (R). Therefore, it is possible to supply the refrigerant to the compression chamber (S4) more smoothly.

Further, as the cutout part (C) is formed to be further engraved in the suction chamber (S1) side than the inflow hole 112*c* to communicate with the groove (G), it is possible to smoothly flow the refrigerant in the suction chamber (S1) into the inflow hole 112*c*. Therefore, it is possible to supply the refrigerant to the compression chamber (S4) more smoothly.

What is claimed is:

1. A scroll compressor, comprising:

a center housing;

a front housing fastened to the center housing and forming a suction chamber;

a rear housing fastened to the center housing and forming a compression mechanism accommodation space;

a fixed scroll provided in the compression mechanism accommodation space; and an orbiting scroll interposed between the center housing and the fixed scroll and forming a compression chamber together with the fixed scroll, wherein the fixed scroll comprises a fixed scroll end plate and a fixed scroll side plate protruded from the outer circumferential portion of the fixed scroll end plate, fastened to the center housing, and forming an orbiting space of the orbiting scroll, wherein the outer circumferential portion of the center housing is formed with an inflow hole for communicating with the suction chamber, wherein the distal end surface of the fixed scroll side plate is formed with a suction port for guiding a refrigerant of the inflow hole to the compression chamber, wherein the suction port comprises a first suction port formed to be engraved from the distal end surface of the fixed scroll side plate toward the fixed scroll end plate for opening a part of the fixed scroll side plate, wherein the circumferential length of the first suction port is formed longer than the circumferential length of the inflow hole, wherein the suction port further comprises a second suction port formed to be engraved from the first suction port toward the fixed scroll end plate for further opening a part of the fixed scroll side plate.

2. The scroll compressor of claim 1, wherein the fixed scroll side plate is formed to overlap the inflow hole in the axial direction.

3. The scroll compressor of claim 1, wherein the circumferential length of the second suction port is formed shorter than the circumferential length of the first suction port.

4. The scroll compressor of claim 3, wherein the orbiting scroll comprises an orbiting scroll end plate and an orbiting scroll lap protruded from the orbiting scroll end plate and engaged with the fixed scroll, and wherein the axial height of the second suction port is formed higher than the axial height of the orbiting scroll end plate.

5. The scroll compressor of claim 4, wherein the second suction port is formed to overlap the orbiting scroll lap in the radius direction.

6. The scroll compressor of claim 4, wherein the axial height of the first suction port is formed to be equal to or lower than the axial height of the orbiting scroll end plate.

7. The scroll compressor of claim 6, wherein the first suction port is formed to overlap the orbiting scroll end plate in the radius direction.

8. The scroll compressor of claim 1, wherein the inflow hole, the first suction port, and the second suction port are formed in plural, respectively, wherein the plurality of first suction ports overlap the plurality of inflow holes in the axial direction, and wherein the fixed scroll side plate comprises a contact part contacting the center housing between the plurality of first suction ports.

9. The scroll compressor of claim 8, wherein the sum of the flow cross-sectional areas of the plurality of second suction ports are formed to be greater than or equal to the sum of the flow cross-sectional areas of the plurality of inflow holes.

10. The scroll compressor of claim 1, wherein the center housing comprises a protrusion protruded from the outer circumferential surface of the center housing in the radius direction, and wherein the protrusion is formed with a fastening hole into which a fastening bolt for fastening the center housing and the rear housing is inserted.

11. The scroll compressor of claim 10, wherein the fixed scroll side plate comprises a recess formed to be engraved from the outer circumferential surface of the fixed scroll side plate not to interfere with a fastening member.

12. The scroll compressor of claim 11, wherein the protrusion, the fastening hole, and the recess are formed in plural, respectively, and wherein the fixed scroll side plate comprises a contact part contacting the center housing between the plurality of recesses.

13. A scroll compressor, comprising:

a center housing;

a front housing fastened to the center housing and forming a suction chamber;

a rear housing fastened to the center housing and forming a compression mechanism accommodation space;

a fixed scroll provided in the compression mechanism accommodation space; and an orbiting scroll interposed between the center housing and the fixed scroll and forming a compression chamber together with the fixed scroll, wherein the fixed scroll comprises a fixed scroll end plate and a fixed scroll side plate protruded from the outer circumferential portion of the fixed scroll end plate, fastened to the center housing, and forming an orbiting space of the orbiting scroll, wherein the outer circumferential portion of the center housing is formed with an inflow hole for communicating with the suction chamber, wherein the distal end surface of the fixed scroll side plate is formed with a suction port for guiding a refrigerant of the inflow hole to the compression chamber, wherein the suction port comprises a first suction port formed to be engraved from the distal end surface of the fixed scroll side plate, wherein the circumferential length of the first suction port is formed longer than the circumferential length of the inflow hole, wherein the center housing comprises a main frame for supporting the fixed scroll and the orbiting scroll; and a plurality of ribs formed radially at the suction chamber side to reinforce the rigidity of the main frame, wherein the plurality of ribs are formed not to reduce the flow cross-sectional area of the inflow hole, wherein the plurality of ribs comprise a non-overlapping rib not overlapping the inflow hole in the axial direction; and an overlapping rib overlapping the inflow hole in the axial direction, and wherein the overlapping rib comprises a cutout part formed to be engraved from the compression mechanism accommodation space side and for communicating with the inflow hole.

14. The scroll compressor of claim 13, wherein the cutout part is formed to be further engraved in the suction chamber side than the inflow hole.

15. The scroll compressor of claim 14, wherein a groove is formed between the plurality of ribs, and wherein the cutout part is formed to communicate with the groove.

* * * * *